United States Patent [19]

Yamamoto et al.

[11] Patent Number: 4,897,132

[45] Date of Patent: Jan. 30, 1990

[54] TURBINE CASING FORMED OF A HEAT RESISTANT AUSTENITIC CAST STEEL

[75] Inventors: Masao Yamamoto; Takashi Yebisuya, both of Tokyo; Osamu Watanabe; Masayuki Yamada, both of Yokohama, all of Japan

[73] Assignee: Kabushiki Kaisha Tohsiba, Kawasaki, Japan

[21] Appl. No.: 127,601

[22] Filed: Nov. 30, 1987

Related U.S. Application Data

[63] Continuation of Ser. No. 933,366, Nov. 18, 1986, abandoned, which is a continuation of Ser. No. 720,271, Apr. 5, 1985, abandoned.

[30] Foreign Application Priority Data

Oct. 3, 1984 [JP] Japan ..... 59-206260

[51] Int. Cl.[4] ..... C22C 38/44

[52] U.S. Cl. ..... 148/327; 420/53

[58] Field of Search ..... 420/53; 148/327

[56] References Cited

U.S. PATENT DOCUMENTS

| | | | |
|---|---|---|---|
| 2,824,797 | 2/1958 | Eberle | 420/53 |
| 3,551,142 | 1/1967 | Decroix | 420/53 |
| 4,102,677 | 7/1978 | Deverell | 75/128 N |

FOREIGN PATENT DOCUMENTS

| | | | |
|---|---|---|---|
| 1219692 | 6/1966 | Fed. Rep. of Germany . | |
| 1483037 | 4/1969 | Fed. Rep. of Germany | 75/128 N |
| 1475735 | 2/1967 | France . | |
| 91296 | 4/1968 | France . | |
| 93081 | 7/1969 | France . | |
| 2146838 | 2/1973 | France . | |
| 47-23314 | 10/1972 | Japan . | |
| 514015 | 6/1974 | Japan . | |
| 52109420 | 3/1976 | Japan . | |
| 55-158256 | 12/1980 | Japan | 148/38 |

OTHER PUBLICATIONS

Lula, R. A., Stainless Steel, American Society for Metals, (1986), pp. 42, 43, 89–92.

Chemical Engineers' Handbook, 5th Ed., McGraw-Hill Book Co., (1973), pp. 23–39 to 23–43.

Handbook of Stainless Steels, D. Peckner, I. M. Bernstein, McGraw-Hill, pp. 2–2; 2–3; and 10–7.

*Primary Examiner*—Deborah Yee

*Attorney, Agent, or Firm*—Oblon, Spivak, McClelland, Maier & Neustadt

[57] ABSTRACT

Disclosed is a heat resistant austenitic cast steel consisting essentially of 0.03 to 0.09% by weight of carbon, 2.0% by weight or less of silicon, 3.0% by weight or less of manganese, 0.11 to 0.30% by weight of nitrogen, 6 to 15% by weight of nickel, 15 to 19.5% by weight of chromium, 0.01 to 1.0% by weight of vanadium, 1 to 5% by weight of molybdenum, and the balance of iron. The heat resistant austenitic cast steel exhibits excellent mechanical properties such as mechanical strength, elongation, reduction of area and fracture time caused by creep fracture, particularly, under high temperatures. If a turbine casing is formed of the cast steel, it is possible to increase the steam temperature and pressure.

9 Claims, 2 Drawing Sheets

TURBINE CASING FORMED OF A HEAT RESISTANT AUSTENITIC CAST STEEL

This application is a continuation of application Ser. No. 933,366, filed on Nov. 18, 1986, now abandoned, which in turn is a continuation of Ser. No. 720,271 filed Apr. 15, 1985, now abandoned.

BACKGROUND OF THE INVENTION

This invention relates to a heat resistant austenitic cast steel with improved mechanical properties such as mechanical strength under high temperatures.

Austenitic steel has a high corrosion resistance and, thus, is widely used as a material for articles used under corrosive conditions. Also, the mechanical properties of austenitic steel are effected less by temperature than those of ferritic steel, making it possible to increase the upper limit of temperature to which austenitic steel can be exposed. Therefore, its application will be broader than ferritic steel.

However, the mechanical strength of austenitic steel is lower than that of ferritic steel. Thus, in order to use the austenitic steel specified by JIS SUS 304 or 316 under high temperatures, it is necessary to reinforce the austenitic steel article or part by increasing the thickness thereof. If the thickness is increased, it is naturally difficult to transport or install the article or part, particularly where the article or part is large. Also, a large temperature gradient is brought about in the thickness direction of the article in the heating step of the article. If heating-cooling treatment is repeatedly applied, thermal fatigue of the article is promoted. Thus, in order to actually increase the upper limit of temperature under which the austenitic steel can be used, it is necessary to improve the mechanical properties of the steel under room temperature and high temperatures.

On the other hand, it is difficult to apply hot forging and cold working to a large article of complex shape such as a turbine casing. Thus, such a large article is produced in many cases by casting. However, the mechanical strength of castings is lower than that of a hot forged article or cold worked material, with the result that the castings should be made thicker. Also, segregation tends to occur in the castings because forging, pressing or the like is not applied to the casting material, resulting in a restriction in the amounts of additional elements that can be used with the casting material. It is also impossible to increase the mechanical strength of the castings by the treatment to diminish the grains.

When it comes to nickel-based alloys, the mechanical strength is increased by precipitating $\gamma'$-phase, such as $Ni_3Al$, in the alloys. However, the $\gamma'$-phase precipitation results in the reduction in the elongation and reduction of area of the material, and requires complex heat treatments. Particularly where the casting defect remains as it is in the castings, the precipitation is changed in the welding step for repairing the casting defect so that the mechanical properties of the material deteriorate. Under the circumstances, it is not practical to increase the mechanical strength of the castings by the $\gamma'$-phase precipitation.

In a thermal power plant using coal or petroleum as the fuel, it is necessary to further heat and pressurize the steam to, for example, 1100° F. and 352 atms. for improving the thermal efficiency. It was customary to use a martensite cast steel such as Cr-Mo-V steel in the turbine of such a thermal power plant. However, since the martensitic cast steel is low in its mechanical strength under high temperatures, it has been attempted to use austenitic cast steel, which is superior to the martensitic cast steel in mechanical strength under high temperatures, for forming such a turbine. Particularly, the turbine casing receives a load of high pressure steam and, thus, requires an improvement in the mechanical strength of the material of which it is formed.

Also, the operating conditions of chemical plants and boilers are becoming more server, leading to a strong demand for the development of a material having a mechanical strength high enough for the material to be used under extremely high temperatures and pressures.

Austenitic cast steel exhibits relatively satisfactory high temperature characteristics, compared with the other materials. However, further improvements are required in its high temperature characteristics such as mechanical stress, proof stress, creep rupture strength, elongation and reduction of area, to enable the austenitic cast steel to be used in the actual apparatus satisfactorily.

SUMMARY OF THE INVENTION

An object of this invention is to provide a heat resistant austenitic cast steel which has high mechanical strength, proof stress, creep rupture strength, elongation and reduction of area under high temperatures, and can be used for forming a turbine casing or the like which is put under high temperatures and high pressures.

According to the present invention, there is provided a heat resistant austenitic cast steel consisting essentially of 0.03 to 0.09% by weight of carbon, 2.0% by weight or less of silicon, 3.0% by weight or less of manganese, 0.11 to 0.3% by weight of nitrogen, 6 to 15% by weight of nickel, 15 to 19.5% by weight of chromium, 0.01 to 1.0% by weight of vanadium, 1 to 5% by weight of molybdenum, and the balance of iron.

The heat resistant austenitic cast steel of the present invention exhibits high mechanical strength and ductility at room temperature and high temperatures, though hot forging, hot working, cold working etc. are not applied thereto. Particularly, the cast steel of the present invention exhibits excellent creep rupture time, rupture elongation and reduction of area under high temperatures. Thus, the steel is highly useful as a material of a turbine part such as a steam turbine casing or as a valve casing material. The use of the invented heat resistant austenitic cast steel permits improving, for example, the power generation efficiency and extending the life of the part of the power plant.

DETAILED DESCRIPTION OF THE PREFERRED EMBODIMENTS

Figure 1:
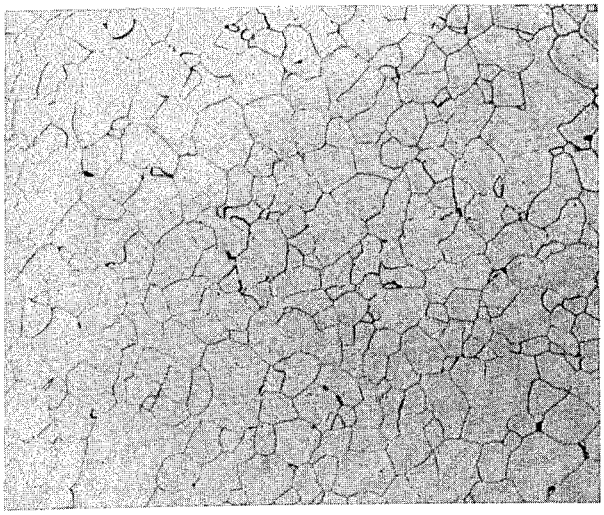
FIG. 1 shows the crystal texture of the cast steel according to Example 7 of the present invention.

The heat resistant austenitic cast steel of the present invention contains 0.03 to 0.09% by weight of carbon. The carbon contained in the cast steel serves to stabilize the austenitic phase and, thus, to increase the mechanical strength of the cast steel. To stabilize the austenitic phase and to ensure a high mechanical strength under high temperatures, the cast steel should contain at least 0.03% by weight of carbon. However, the carbon content should not exceed 0.09% by weight because segregation tends to occur in the cast steel if the carbon content is higher than 0.09%. The segregation is not eliminated even if a homogenizing treatment is applied to the cast steel by heating to 1000° C. or more. Also, a high carbon content results in deterioration in the elongation, reduction of area and corrosion resistance of the cast steel. In order to further increase the mechanical strength, creep fracture elongation and reduction of the area of the cast steel, at room temperature, the carbon content should desirably be higher than 0.04%, but should be lower than 0.08% by weight.

The cast steel of the present invention also contains 2.0% by weight or less of silicon which acts as a deoxidizer in the preparation of the steel. Specifically, silicon serves to improve the flowability of the molten steel and to enhance the welding property of the produced cast steel. However, the silicon content exceeding 2.0% by weight causes deterioration in the strength of the cast steel. Also, if the silicon content is too low, the flowability of the molten steel is impaired, leading to the occurrence pin hole in the cast steel. Desirably, the silicon content should fall within the range of between 0.3 and 0.9% by weight.

The cast steel of the present invention also contains 3.0% by weight or less of manganese which acts as a deoxidizer in the preparation of the steel and serves to stabilize the austenitic phase. However, the Mn content higher than 3.0% by weight causes deterioration in the corrosion resistance such as oxidation resistance of the cast steel. Also, the mechanical strength of the cast steel under room temperature or high temperatures may possibly be lowered if the Mn content is higher than 0.3%. In view of the mechanical strength under room temperature, creep rupture elongation and reduction of the area of the cast steel, the Mn content of the cast steel should desirably range between 0.5 and 1.9% by weight.

It is important to note that the cast steel of the present invention contains nitrogen which serves to stabilize the austenitic phase. Also, nitrogen is solubilized in austenitic phase and is precipitated as a nitride so as to increase the proof strength or creep rupture strength of the cast steel. In order to obtain the particular effect, the cast steel should contain at least 0.11% by weight of nitrogen. However, the nitrogen content should not exceed 0.3% by weight. If the nitrogen content exceeds 0.3%, pin holes or blow holes are formed in the preparation of the steel or in the welding step. Also, nitrides are precipitated in the grain boundaries, resulting in deterioration in the creep rupture strength, creep rupture elongation and the reduction of the area of the cast steel. In addition, the strength of the cast steel is impaired. When it comes to a forged steel, the pin holes and blow holes can be eliminated by the forging treatment. However, forging is not applied to the cast steel. Thus, it is desirable to set the nitrogen content at 0.25% or less in order to avoid the occurrence of pin holes and blow holes. On the other hand, the nitrogen content should desirably be 0.13% by weight or more in order to further improve the creep rupture strength and to prolong the creep rupture time. What should also be noted is that, in the general nitrogen adding method, molten steel is held under a nitrogen gas atmosphere of 1 atm. so as to add nitrogen to the molten steel. In this case, the nitrogen content in the molten steel is at most 0.2% by weight. Under the circumstances, it is practical to set the nitrogen content at 0.13 to 0.19% by weight.

The cast steel of the present invention also contains 6 to 15% by weight of nickel which serves to convert the phase of the cast steel to austenite and to improve the corrosion resistance and welding property of the cast steel. The austenitic phase and particular effect cannot be obtained if the nickel content is less than 6%. On the other hand, the creep rupture strength, creep rupture elongation and the reduction of the area of the cast steel are rapidly lowered since a precipitate free zone is formed near the grain boundary, if the nickel content exceeds 15%. In order to stabilize the austenite phase and to improve the creep rupture strength, creep rupture elongation and the reduction of the area, the nickel content should desirably range between 8.5 and 12% by weight. However, where the cast steel contains another component of chromium in an amount of 16 to 19% by weight, the nickel content should desirably range between 9.5 and 11.5% by weight.

The cast steel of the present invention also contains 15 to 19.5% by weight of chromium which serves to improve the mechanical strength of the cast steel at room temperature and high temperatures and to promote the corrosion resistance and oxidation resistance of the cast steel. The particular effect cannot be obtained if the chromium content is less than 15%. However, the cast steel containing more than 19.5% of chromium gives rise to serious defects when the cast steel is used for a long time under high temperatures. For example, $\sigma$-phase is formed so as to deteriorate the toughness of the cast steel. Also, a ferrite phase is formed, making it impossible to obtain a cast steel consisting of an austenite phase only. In this case, the thermal fatigue resistance of the cast steel deteriorates. It should be noted that the nitrogen addition is facilitated if the chromium content is high. It is also necessary to consider the balance between nickel and chromium. In view of the above, the chromium content should desirably be 16% or more. Further, the chromium content should desirably be 18.5% or less in view of the creep rupture strength of the cast steel.

The cast steel also contains vanadium, which is most important in the present invention. Vanadium is soluble in the austenite phase and is combined with nitrogen or carbon so as to form fine precipitates. As a result, the creep rupture strength, creep rupture elongation and the reduction of the area of the cast steel are improved. To obtain the particular effect, the vanadium content of the cast steel should be at least 0.01% by weight. If the vanadium content is excessive, however, segregation occurs in the cast steel, resulting in reduction in the creep strength, creep rupture elongation and the reduction of the area of the cast steel. The segregation cannot be eliminated, even if a homogenizing treatment is applied to the cast steel at 1000° C. or more. To avoid the segregation occurrence, the vanadium content should be 1.0% by weight or less. In view of the mechanical properties of the cast steel under high temperatures, the vanadium content should desirably range between 0.03 and 0.5% by weight. Further, the vanadium content should more desirably range between 0.05 and 0.35% in view of the reduction of the area of the cast steel in the creep fracture.

The cast steel of the present invention also contains 1 to 5% by weight of molybdenum, which performs an interaction with vanadium to improve the creep rupture strength, creep rupture elongation and the reduction of area of the cast steel. Where the cast steel contains niobium, titanium, tungsten or boron, molybdenum also performs an interaction with one of the additional elements mentioned. To obtain the particular effect, the molybdenum content should be at least 1%. However, if the cast steel contains more than 5% of molybdenum, a ferrite phase is formed and segregation takes place, resulting in deterioration in the mechanical properties of the cast steel under high temperatures. In order to further improve the mechanical strength under high temperatures, the molybdenum content should range between 1.5 and 3.5% by weight. Further, the molybdenum content should more desirably be 2 to 3% by weight particularly where the cast steel is used for forming large castings.

The austenitic cast steel of the present invention may further contain at least one of niobium, titanium, boron and tungsten. Niobium serves to improve the creep rupture strength and to suppress the secondary creep velocity of the cast steel. To obtain the particular effect, the niobium content of the cast steel should be at least 0.01% by weight. However, if the niobium content exceeds 0.5% by weight, ferrite phase is locally formed in the cast steel and segregation takes place in the cast steel, resulting in a reduction in the creep rupture strength, creep rupture elongation and a reduction of area of the cast steel. It is impossible to eliminate the segregation even by a heat treatment at 1000° C. or more. In order to suppress segregation and to further improve the high temperature characteristics of the cast steel, the niobium content of the cast steel should desirably range between 0.02 and 0.10% by weight.

Titanium, if added in an amount of 0.002% or more, serves to improve the creep fracture strength of the cast steel. However, if the titanium content exceeds 0.5% by weight, segregation occurs in the cast steel. Also, the creep fracture elongation and the reduction of area of the cast steel are impaired. In order to further improve the high temperature characteristics of the cast steel, the titanium content of the cast steel should desirably range between 0.02 and 0.15% by weight.

Boron, if added in an amount of at least 0.0005% by weight, serves to improve the creep fracture strength of the cast steel and to promote the elongation in the ternary creep. However, if the boron content of the cast steel is higher than 0.01% by weight, the grain boundary of the cast steel is weakened. In order to increase the effect produced by the boron addition, the boron content should desirably range between 0.003 and 0.007% by weight.

Further, tungsten, if added in an amount of at least 0.5% by weight, is soluble in austenitic phase so as to increase the creep rupture strength of the cast steel. However, if the tungsten content of the cast steel is higher than 5% by weight, segregation takes place in the cast steel. The tungsten content should desirably range between 1 and 3% by weight.

Iron constitutes the balance of the cast steel of the present invention, though some impurities are unavoidably contained in the cast steel. It is necessary to prevent the cast steel from containing phosphorus, sulfur and aluminum as much as possible, because these impurities weaken the grain boundary of the cast steel. The total amount of these impurities should be held at 0.05% by weight or less. Particularly, the total amount of phosphorus and sulfur should be held at 0.02% or less in order to prevent the cast steel article from turning brittle during use over a long period of time.

The austenitic cast steel of the composition described above permits the formation of fine crystal grains which cannot be formed in the conventional cast steel. Further, the crystal grains can be made more uniform and finer by adjusting the nickel equivalent and chromium equivalent as follows. Specifically, the nickel equivalent is represented by formula (1) given below:

$$\text{Ni equivalent} = (\text{Ni}) + 30\,(\text{C}) + 25.7\,(\text{N}) + 0.5\,(\text{Mn}) \qquad (1)$$

Likewise, the chromium equivalent is represented by formula (2) given below:

$$\text{Cr equivalent} = (\text{Cr}) + 1.2\,(\text{Si}) + (\text{Mo}) + 5\,(\text{V}) + 0.5\,(\text{Nb}) + 0.75\,(\text{W}) + 1.5\,(\text{Ti}) + 40\,(\text{B}) \qquad (2)$$

The symbol "( )" denotes the percentage of the component put therein.

In the present invention, the nickel equivalent should be 16 to 24%, desirably, 16 to 22%. Likewise, the chromium equivalent should be 18 to 24%, desirably, 19 to 23%. This condition permits providing a composition optimum for forming fine crystal grains.

If the cast steel consists of fine crystal grains, it is possible to improve the high temperature characteristics of the cast steel such as the proof strength, elongation and reduction of area. It is also possible to suppress the thermal fatigue of the cast steel. Moreover, if the crystal grains are fine, the defect of the castings can be readily detected by an ultrasonic flaw detector In terms of the mechanical properties of the cast steel, the average area of the grain should be 2 $mm^2$ or less, desirably, 1 $mm^2$ or less.

The heat resistant austenitic cast steel of the present invention described above exhibits high mechanical strength, proof strength, creep rupture strength, creep rupture elongation and a reduction of area at room temperature and high temperatures and, thus, is suitable for use as the material of the castings put under high temperatures. Particularly, the cast steel of the present invention is suitable for forming a turbine casing. If the turbine casing is formed of the cast steel of the present invention, it is possible to increase the steam temperature and pressure, leading to an improvement in the thermal efficiency of the thermal power plant.

EXAMPLES 1 TO 25 AND CONTROLS 1 TO 8

Chemical compositions of cast steel samples are shown in Table 1.

Mechanical properties of the cast steel samples were measured at room temperature and high temperatures. The amount of phosphorus, sulfur and aluminum contained in each sample shown in Table 1 was less than 0.01% by weight. The sample of Control 1 corresponds to austenitic stainless steel SUS 316. For preparing each sample, the steel composition was melted in a high frequency induction furnace and, then, casted in a mold to obtain an ingot having a diameter of 50 mm. The ingot was kept at 1100° C. for 24 hours, for the homogenizing purpose, then cooled in the furnace. Further, the ingot was heated at 800° C. for 8 hours for the stabilizing purpose so as to obtain the cast steel sample.

TABLE 1

| | C | Si | N | Mn | Cr | Ni | Mo | V | Nb | Ti | B | W | Fe | Ni Equivalent | Cr Equivalent |
|---|---|---|---|---|---|---|---|---|---|---|---|---|---|---|---|
| Example 1 | 0.05 | 0.4 | 0.23 | 0.8 | 18.4 | 9.3 | 2.3 | 0.09 | — | — | — | — | Bal | 17.1 | 21.6 |
| Example 2 | 0.06 | 0.5 | 0.24 | 1.0 | 17.9 | 10.2 | 2.3 | 0.11 | — | — | — | — | " | 18.7 | 21.4 |
| Example 3 | 0.05 | 0.5 | 0.25 | 1.1 | 18.5 | 11.4 | 2.4 | 0.13 | — | — | — | — | " | 19.9 | 22.2 |
| Example 4 | 0.05 | 0.5 | 0.25 | 1.0 | 18.2 | 12.6 | 2.2 | 0.09 | — | — | — | — | " | 21.0 | 21.5 |
| Example 5 | 0.05 | 0.4 | 0.13 | 1.2 | 16.9 | 8.0 | 2.1 | 0.08 | — | — | — | — | " | 13.4 | 19.9 |
| Example 6 | 0.06 | 0.6 | 0.15 | 1.0 | 17.2 | 10.3 | 2.3 | 0.10 | — | — | — | — | " | 16.5 | 20.7 |
| Example 7 | 0.05 | 0.7 | 0.14 | 1.1 | 17.0 | 11.2 | 2.3 | 0.11 | — | — | — | — | " | 16.8 | 20.7 |
| Example 8 | 0.06 | 0.5 | 0.16 | 0.9 | 16.7 | 12.0 | 2.4 | 0.12 | — | — | — | — | " | 18.4 | 20.3 |
| Example 9 | 0.06 | 0.5 | 0.15 | 0.9 | 17.1 | 13.4 | 2.2 | 0.09 | — | — | — | — | " | 19.5 | 20.4 |
| Example 10 | 0.07 | 0.3 | 0.23 | 1.0 | 18.5 | 10.5 | 2.8 | 0.08 | — | — | — | — | " | 19.0 | 22.1 |
| Example 11 | 0.07 | 0.4 | 0.24 | 1.0 | 18.0 | 10.5 | 2.7 | 0.19 | — | — | — | — | " | 19.3 | 22.1 |
| Example 12 | 0.08 | 0.4 | 0.20 | 1.2 | 17.9 | 10.6 | 2.7 | 0.31 | — | — | — | — | " | 18.7 | 22.6 |
| Example 13 | 0.05 | 0.8 | 0.19 | 1.3 | 18.2 | 10.2 | 2.1 | 0.09 | — | — | — | — | " | 17.2 | 21.7 |
| Example 14 | 0.06 | 0.6 | 0.18 | 0.8 | 18.2 | 10.1 | 1.9 | 0.10 | 0.09 | — | — | — | " | 16.9 | 21.4 |
| Example 15 | 0.05 | 0.6 | 0.19 | 0.7 | 18.4 | 10.3 | 2.2 | 0.10 | — | 0.08 | — | — | Bal | 17.0 | 21.9 |
| Example 16 | 0.05 | 0.7 | 0.20 | 0.8 | 18.1 | 10.2 | 2.2 | 0.11 | — | — | 0.005 | — | " | 17.2 | 21.9 |
| Example 17 | 0.06 | 0.6 | 0.18 | 0.8 | 18.0 | 10.0 | 2.3 | 0.10 | — | — | — | 1.6 | " | 16.8 | 22.7 |
| Example 18 | 0.05 | 0.5 | 0.15 | 1.0 | 16.5 | 11.1 | 2.6 | 0.09 | 0.1 | 0.09 | — | — | " | 17.0 | 20.3 |
| Example 19 | 0.06 | 0.5 | 0.14 | 0.9 | 17.3 | 11.3 | 2.7 | 0.11 | 0.1 | — | 0.006 | — | " | 17.1 | 21.4 |
| Example 20 | 0.05 | 0.4 | 0.16 | 0.8 | 17.0 | 10.9 | 2.4 | 0.11 | 0.08 | — | — | 1.4 | " | 16.9 | 21.5 |
| Example 21 | 0.03 | 0.6 | 0.13 | 2.3 | 16.3 | 10.9 | 2.3 | 0.10 | — | 0.07 | 0.004 | — | " | 16.3 | 20.1 |
| Example 22 | 0.03 | 0.6 | 0.13 | 1.6 | 16.0 | 11.2 | 2.3 | 0.09 | — | 0.08 | — | 2.0 | " | 16.2 | 21.1 |
| Example 23 | 0.04 | 0.5 | 0.13 | 2.0 | 18.9 | 11.0 | 2.5 | 0.08 | — | — | 0.004 | 1.1 | " | 16.5 | 23.4 |
| Example 24 | 0.05 | 0.5 | 0.14 | 1.2 | 17.4 | 11.0 | 2.5 | 0.10 | 0.08 | 0.07 | 0.005 | 1.3 | " | 16.7 | 22.3 |
| Example 25 | 0.05 | 0.7 | 0.15 | 0.8 | 17.0 | 10.9 | 2.6 | 0.26 | 0.04 | 0.03 | 0.003 | 1.2 | " | 16.7 | 22.8 |
| Control 1 | 0.06 | 0.4 | — | 0.8 | 16.8 | 12.3 | 2.39 | — | — | — | — | — | Bal | 14.5 | 19.7 |
| Control 2 | 0.05 | 0.5 | 0.14 | 1.2 | 17.1 | 15.5 | 2.4 | 0.11 | — | — | — | — | " | 21.2 | 20.7 |
| Control 3 | 0.06 | 0.5 | 0.19 | 0.9 | 18.2 | 9.7 | 2.6 | — | — | — | — | — | " | 16.8 | 21.4 |
| Control 4 | 0.07 | 0.4 | 0.17 | 1.2 | 18.4 | 11.9 | 2.76 | 1.2 | — | — | — | — | Bal | 19.0 | 27.6 |
| Control 5 | 0.05 | 0.6 | 0.05 | 0.86 | 17.2 | 10.9 | 2.4 | 0.15 | — | — | — | — | " | 14.1 | 21.1 |
| Control 6 | 0.05 | 0.8 | 0.07 | 0.91 | 17.3 | 11.0 | 2.3 | 0.10 | — | — | — | — | " | 14.8 | 21.1 |
| Control 7 | 0.06 | 0.8 | 0.10 | 0.89 | 17.3 | 10.8 | 2.5 | 0.10 | — | — | — | — | " | 15.6 | 21.3 |
| Control 8 | 0.11 | 0.5 | 0.17 | 0.48 | 18.9 | 10.1 | 3.0 | 0.10 | — | — | — | — | " | 18.0 | 23.0 |

A tensile test at room temperature and a creep rupture test at 700° C. were applied to each sample measured in the tensile test were 0.2% proof strength (0.2% P.S.), tensile strength (T.S.), elongation (E.L.) and reduction of area (R.A.) of the sample. In the creep rupture test, 18, kg/mm$^2$ of stress was applied to each sample at 700° C. to obtain rupture time (R.T.), rupture elongation (R.E.) and rupture reduction of area (R.R.A). Table 2 shows the results.

TABLE 2

| | Room temperature | | | | 700° C., 18 kg/mm$^2$ Creep Rupture Test | | |
|---|---|---|---|---|---|---|---|
| | P.S. (kg/mm$^2$) | T.S. (kg/mm$^2$) | E.L. (%) | R.A. (%) | R.T. (Hr) | R.E. (%) | R.R.A. (%) |
| Example | | | | | | | |
| 1 | 28.7 | 57.3 | 61.6 | 68.2 | 136 | 42 | 50 |
| 2 | 28.4 | 56.9 | 64.7 | 72.5 | 170 | 48 | 57 |
| 3 | 27.0 | 56.3 | 60.8 | 65.1 | 111 | 38 | 50 |
| 4 | 26.4 | 54.7 | 68.8 | 63.6 | 95 | 29 | 36 |
| 5 | 31.1 | 67.5 | 64.4 | 61.2 | 75 | 26 | 41 |
| 6 | 30.2 | 64.9 | 67.5 | 73.8 | 207 | 48 | 52 |
| 7 | 30.0 | 64.1 | 62.2 | 70.8 | 223 | 45 | 54 |
| 8 | 29.8 | 63.7 | 65.0 | 65.6 | 196 | 39 | 51 |
| 9 | 27.1 | 58.8 | 60.7 | 62.4 | 131 | 26 | 49 |
| 10 | 29.2 | 60.6 | 50.4 | 64.8 | 139 | 29 | 31 |
| 11 | 29.4 | 61.3 | 54.9 | 66.3 | 223 | 38 | 46 |
| 12 | 29.5 | 61.7 | 63.8 | 65.6 | 275 | 48 | 71 |
| 13 | 27.5 | 61.4 | 62.5 | 72.3 | 102 | 47 | 56 |
| 14 | 32.6 | 63.2 | 61.0 | 60.4 | 195 | 54 | 57 |
| 15 | 30.1 | 58.4 | 61.3 | 57.5 | 125 | 36 | 49 |
| 16 | 27.9 | 60.9 | 63.0 | 68.8 | 110 | 50 | 54 |
| 17 | 29.3 | 60.6 | 63.4 | 65.8 | 133 | 50 | 57 |
| 18 | 33.1 | 63.8 | 53.6 | 55.1 | 235 | 28 | 29 |
| 19 | 30.0 | 62.1 | 62.7 | 62.6 | 232 | 33 | 38 |
| 20 | 31.8 | 63.3 | 59.9 | 61.4 | 144 | 40 | 42 |
| 21 | 28.9 | 58.0 | 54.8 | 55.2 | 121 | 34 | 51 |
| 22 | 29.5 | 61.4 | 58.6 | 60.9 | 130 | 37 | 50 |
| 23 | 27.1 | 57.2 | 59.0 | 60.3 | 116 | 49 | 55 |
| 24 | 32.2 | 67.0 | 59.1 | 56.7 | 255 | 27 | 33 |

TABLE 2-continued

| | Room temperature | | | | 700° C., 18 kg/mm$^2$ Creep Rupture Test | | |
|---|---|---|---|---|---|---|---|
| | P.S. (kg/mm$^2$) | T.S. (kg/mm$^2$) | E.L. (%) | R.A. (%) | R.T. (Hr) | R.E. (%) | R.R.A. (%) |
| 25 | 31.6 | 65.9 | 62.0 | 63.4 | 340 | 35 | 36 |
| Control | | | | | | | |
| 1 | 14.1 | 38.9 | 51.5 | 59.9 | 3 | 58 | 62 |
| 2 | 18.7 | 47.5 | 47.0 | 52.1 | 25 | 17 | 19 |
| 3 | 25.2 | 58.8 | 47.5 | 56.5 | 28 | 30 | 31 |
| 4 | 35.3 | 67.4 | 37.1 | 35.2 | 35 | 13 | 17 |
| 5 | 18.9 | 46.7 | 69.0 | 64.6 | 9 | 44 | 45 |
| 6 | 20.3 | 48.6 | 62.4 | 64.5 | 9 | 38 | 49 |
| 7 | 22.3 | 51.4 | 58.9 | 66.5 | 30 | 34 | 42 |
| 8 | 26.5 | 59.7 | 62.1 | 47.8 | 114 | 9 | 15 |

As apparent from Table 2, the Examples of the present invention were found markedly superior to the Control cases in the rupture time (R.T.) and the mechanical properties at room temperature and a high temperature.

Table 3 shows the nickel equivalent, chromium equivalent and the average area of the grain with respect to Examples 5, 7, 12, 23 and Controls 1, 4.

TABLE 3

| | Ni equiv. (%) | Cr equiv. (%) | Fineness Deg. | Ave. Surface Area (mm$^2$) |
|---|---|---|---|---|
| Example | | | | |
| 5 | 13.4 | 19.9 | Partly Coarse | 0.33 |
| 7 | 16.8 | 20.7 | Entirely Fine | 0.015 |
| 12 | 18.7 | 22.6 | Entirely Fine | 0.12 |
| 23 | 16.5 | 23.4 | Partly Coarse | 0.52 |
| Control | | | | |
| 1 | 14.5 | 19.7 | Entirely Coarse | 3.4 |
| 4 | 19.0 | 27.6 | Entirely | 3.1 |

TABLE 3-continued

| Ni equiv. (%) | Cr equiv. (%) | Fineness Deg. | Ave. Surface Area ($mm^2$) |
|---|---|---|---|
| | | Fine | |

Figure 2:
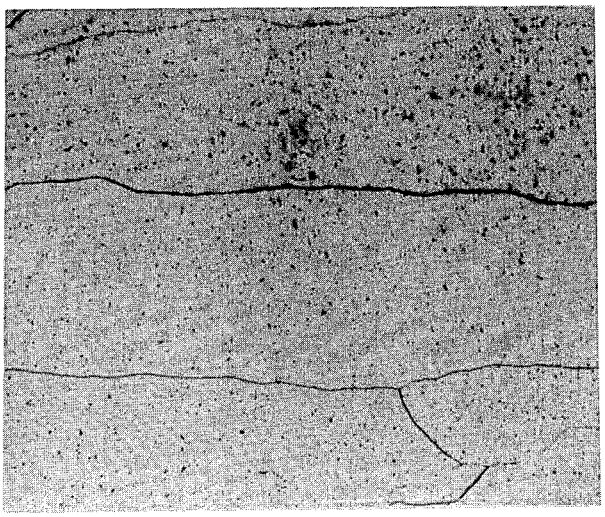
FIG. 2 shows the crystal texture of the cast steel according to Control 1.

FIGS. 1 and 2 are microphotographs (magnification of 75) showing the crystal textures of Example 7 and Control 1, respectively. It is seen that the crystal grains of Example 7 (FIG. 1) are markedly finer than those of Control 1. Thus, it was possible to apply an ultrasonic flaw detector to the sample of Example 7 for detecting defects, though it was impossible to detect defects in the sample of Control 1 by the ultrasonic flaw detector.

Figure 3:
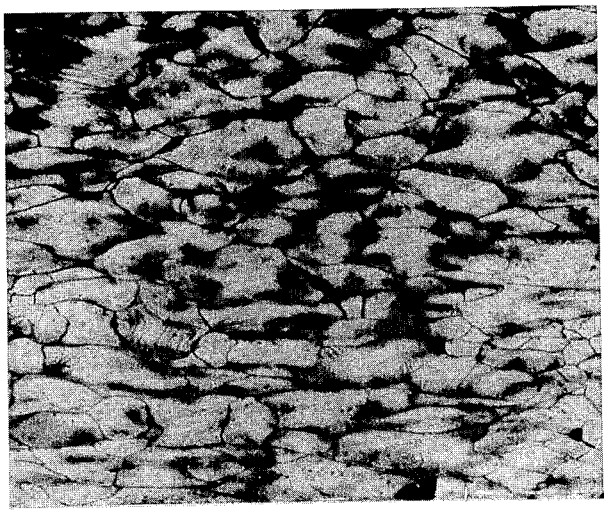
FIG. 3 shows the crystal texture after creep rupture of the cast steel according to Example 7 of the present invention.

FIG. 3 is a microphotograph (magnification of 75) showing the crystal texture of Example 7 after a creep rupture. It is seen that the crystal grains after the creep fracture are sufficiently elongated in the tensile direction, proving that the crystal texture of Example 7 contributes to the improvement in the elongation and the reduction of area of the cast steel.

What is claimed is:

1. A turbine casing formed of a heat resistant austenitic cast steel consisting of 0.04 to 0.08% by weight of carbon, 2.0% by weight or less of silicon, 0.5–1.9% by weight of manganese, 0.1 to 0.30% by weight of nitrogen, 8.5 to 12% by weight of nickel, 15 to 19.5% by weight of chromium, 0.05 to 0.35 by weight of vanadium, 2 to 3% by weight of molybdenum, 0 to 0.5% by weight of niobium, 0 to 0.5% by weight of titanium and 0 to 0.01 by weight of boron, the balance being iron apart from incidental impurities, said cast steel having been subjected to a homogenizing heat treatment of the as cast steel.

2. The turbine casing according to claim 1, wherein the silicon content of the cast steel is 0.3 to 0.9% by weight.

3. The turbine casing according to claim 1 wherein the nitrogen content of the cast steel is 0.13 to 0.19% by weight.

4. The turbine casing according to claim 1 wherein the chromium content and nickel content of the cast steel are 16 to 19% and 9.5 to 11.5% by weight, respectively.

5. The turbine casing according to claim 1, wherein the austenitic cast steel contains at least one of 0.01 to 0.5% by weight of niobium, 0.002 to 0.5% by weight of titanium and 0.0005 to 0.01% by weight of boron.

6. The turbine casing according to claim 5, wherein the niobium content of the cast steel is 0.02 to 0.10% by weight.

7. The turbine casing according to claim 6, wherein the titanium content of the cast steel is 0.02 to 0.15% by weight.

8. The turbine casing according to claim 7, wherein the boron content of the cast steel is 0.0003 to 0.007% by weight.

9. A turbine casing according to claim 1, wherein the nicket equivalent and the chromium equivalent of cast steel, which are defined below, are 16 to 24% and 18 to 24% by weight, respectively:

$$\text{Ni equivalent} = (Ni) + 30\,(C) + 25.7\,(N) + 0.5\,(Mn)$$

$$\text{Cr equivalent} = (Cr) + 1.2\,(Si) + (Mo) + 5\,(V) + 0.5\,(Nb) + 1.5\,(Ti) + 40\,(B).$$

* * * * *